US005797156A

United States Patent [19]

Sebor

[11] Patent Number: 5,797,156

[45] **Date of Patent: *Aug. 25, 1998**

[54] VIBRATORY CLEANER AND METHOD

[76] Inventor: Pavel Sebor, 751 Cricklewood Ter., Heathrow, Fla. 32746

[ * ] Notice: The term of this patent shall not extend beyond the expiration date of Pat. No. 5,404,607.

[21] Appl. No.: 474,991

[22] Filed: Jun. 7, 1995

Related U.S. Application Data

[63] Continuation-in-part of Ser. No. 307,938, Sep. 16, 1994, Pat. No. 5,664,275, and Ser. No. 288,998, Aug. 11, 1994, which is a continuation of Ser. No. 978,237, Nov. 18, 1992, Pat. No. 5,404,607, which is a continuation-in-part of Ser. No. 880,662, May 11, 1992, abandoned, Ser. No. 880,663, May 11, 1992, Pat. No. 5,259,258, Ser. No. 880,664, May 11, 1992, Pat. No. 5,303,444, Ser. No. 880,665, May 11, 1992, Pat. No. 5,371,910, Ser. No. 880,666, May 11, 1992, Pat. No. 5,274,868, Ser. No. 880,667, May 11, 1992, Pat. No. 5,285,547, Ser. No. 880,668, May 11, 1992, Pat. No. 5,259,082, and Ser. No. 880,669, May 11, 1992, Pat. No. 5,261,287.

[51] Int. Cl.[6] ..... F04H 4/16

[52] U.S. Cl. ..... 15/1.7; 92/125; 251/175; 137/527

[58] Field of Search ..... 15/1.7, 420, 421, 15/404, 416; 92/125; 251/175, 176; 137/110, 112, 527.8, 527.6, 527; 210/169; 280/28.5

[56] References Cited

U.S. PATENT DOCUMENTS

| | | | |
|---|---|---|---|
| 4,023,227 | 5/1977 | Chauvier | 15/1.7 |
| 4,133,068 | 1/1979 | Hofmann | 15/1.7 |
| 4,208,752 | 6/1980 | Hofmann | 15/1.7 |
| 4,275,474 | 6/1981 | Woodard | 15/1.7 |
| 4,521,933 | 6/1985 | Raubenheimer | 15/1.7 |
| 4,536,908 | 8/1985 | Raubenheimer | 15/1.7 |
| 4,807,318 | 2/1989 | Kallenbach | 15/1.7 |
| 4,939,806 | 7/1990 | Supra | 15/1.7 |
| 5,293,659 | 3/1994 | Rief et al. | 15/1.7 |
| 5,404,607 | 4/1995 | Sebor | 15/1.7 |
| 5,418,994 | 5/1995 | Rissik et al. | 15/1.7 |
| 5,428,854 | 7/1995 | Rief et al. | 15/1.7 |

FOREIGN PATENT DOCUMENTS

| | | |
|---|---|---|
| 61-75071 | 4/1986 | Japan . |

*Primary Examiner*—Gary K. Graham
*Attorney, Agent, or Firm*—Allen, Dyer, Doppelt, Milbrath & Gilchrist, P.A.

[57] ABSTRACT

A submersible cleaner adapted for travelling across surfaces of swimming pools and which avoids significant wear on an associated suction pump includes a housing with a forward edge, a suction chamber within the housing and a vibratory oscillator positioned within the suction chamber to continuously vibrate the cleaner during operation. A shoe member is removably fitted to the bottom of the housing and has rows of segmented tread elements which are elongated in a direction parallel with the front edge of the housing and which are angled rearwardly from the bottom with respect to the direction of travel in order to cooperate with the vibratory movement and urge the cleaner along the direction of travel.

29 Claims, 10 Drawing Sheets

VIBRATORY CLEANER AND METHOD

CROSS REFERENCE TO RELATED APPLICATIONS

This application is a continuation-in-part of application Ser. No. 08/307,938 filed Sep. 16, 1994 now U.S. Pat. No. 5,664,285, and a continuation-in-part of application Ser. No. 08/288,998, filed on Aug. 11, 1994, which is a continuation of application Ser. No. 07/978,237 filed Nov. 18, 1992, now U.S. Pat. No. 5,404,607 which in turn is a continuation-in-part of the following applications all of which have a United States filing date of May 11, 1992 and a foreign priority date of Feb. 2, 1992:

| Serial No. | Title | Issued As U.S. Pat: |
|---|---|---|
| 07/880,662 | Ground Engaging Means for a Submersible Cleaning Device | Abandoned |
| 07/880,663 | Friction Clutch Drive for a Submersible Cleaning Device | 5,259,258 (11/9/93) |
| 07,880,664 | Rigid Skirt for Bristles of a Submersible Cleaning Device | 5,303,444 (4/9/94) |
| 07,880,665 | Sliding Oscillator Seal for a Submersible Cleaning Device | 5,371,910 (12/13/94) |
| 07/880,666 | Elevation Limiter for a Submersible Cleaning Device | 5,274,868 (1/4/94) |
| 07/880,667 | Internal By-Pass Valve for a Submersible Cleaning Device | 5,285,547 (2/15/94) |
| 07/880,668 | Mechanism for Dislodging a Submersible Cleaning Device from the Surface | 5,259,082 (11/9/93) |
| 07/880,669 | Positive Engagement Clutch for a Submersible Cleaning Device | 5,261,287 (11/6/93) |

This application and the above referenced applications and issued patents are commonly owned.

BACKGROUND OF INVENTION

1. Field of Invention

The invention relates to a vibratory swimming pool cleaner and in particular to an improved submersible suction cleaner for dislodging and collecting debris while randomly traveling along the submerged surfaces of a swimming pool.

2. Background of this Invention (a) General Description of the Prior Art

Self-propelled suction cleaners are customarily used for cleaning the submerged surfaces of pools and in particular, swimming pools having various surface finishes and contoured shapes. Various techniques have been employed in the mechanisms that drive these self-propelled cleaners. The more common mechanisms use either a shut off valve or a turbine to impart movement to the cleaner. Examples of these are discussed next.

U.S. Pat. No. 4,536,908 to Raubenheimer discloses a suction cleaner for a swimming pool supported on a bogie or truck assembly with supporting feet which is mechanically rocked by a gear train driven by a turbine through which water is pulled by suction. To change the direction of the cleaner, a second turbine drives a hose connection in opposite directions for intermittent periods.

A turbine driven swimming pool cleaner is also disclosed in U.S. Pat. No. 4,939,806 to Supra, which employs a suction passage and a propeller which is driven by a turbine and which propels the cleaner. A rudder, which is oscillated via a gear train driven by the turbine, is used to vary the direction of movement.

A turbine and wheel device is disclosed in U.S. Pat. No. 5,099,535 to Chauvier, which employs a suction passage extending between an inlet and outlet in the cleaner body connectable to the inlet of a filtration system. A second hose connects the inlet on the device to an outlet of the system. Water flowing under pressure to the inlet drives a turbine which in turn drives hind wheels to displace the apparatus over the surface while debris or the like is sucked up through the suction passage and then to the filtration system.

U.S. Pat. No. 4,208,752 to Hofmann discloses a swimming pool cleaner using a balanced operating head having an inlet and an outlet, with the outlet swiveled to a suction hose to achieve a stepwise movement over the pool walls.

U.S. Pat. No. 4,807,318 to Kallenbach discloses an automatic pool cleaner which uses on the interruption of an induced flow of water through the cleaner to provide a propulsive force. The flow of water through the cleaner causes a suction in a passageway, permitting a spring and diaphragm to force the closure of the passageway. The intermittent interruption of flow through the passageway and hose and the simultaneous release of the force holding the cleaner and disc against the submerged surface, causes the cleaner to move in a stepwise manner over the surface to be cleaned.

In addition to the movement mechanisms described above, various techniques have been employed in these prior art devices to provide control over the cleaning pattern and for control of the cleaner when encountering obstacles such as abrupt surface changes and to prevent the cleaner from exiting the pool.

In cleaning devices using shut off valve techniques, the valve intake tends to clog easily with larger debris and in order to correct this condition, the cleaning device must be removed from the pool and disassembled for cleaning. The membranes used in some of these units have a tendency to break and require replacement. The dramatic reduction of flow needed to create the step by step movement of the cleaning device results in severe changes in the pressure head at the suction pump, thus placing additional wear on this pump and motor, and are typically noisy.

Cleaning devices using turbines depend on the high speed movement of the turbine; as a result, a large number of bearings and a complex multitude of parts are required to convert the high speed of the turbine to a relatively slow cleaner movement. Bearings tend to perform poorly in the high grit conditions of a swimming pool.

Cleaning devices relying on wheels or feet for their traction encounter problems when climbing the vertical walls of typical swimming pools. The wheels or feet have inadequate traction and often slip in attempting to maneuver on the vertical wall, and will also slip under certain conditions when climbing from the deep end to the shallow end of the pool.

Many of the prior art swimming pool cleaners tend to follow an established travel pattern once placed into operation. Finally, the onset of new plastic and fiberglass swimming pool surfaces creates the added demand that these devices maneuver over surfaces with much lower friction than in the past.

Thus, the goal is to find a pool cleaner which will cover the desired submerged surfaces, be able to execute vertical walls, escape obstacles, avoid climbing out of the pool to prevent air intake, avoid excess demand on the suction pump and motor, have as few moving parts as possible, operate quietly, have compact dimensions, and be easy to install and maintain.

(b) Background of Mr. Sebor's Developments

Prior to November 1989, Mr. Pavel Sebor conceived of and built prototypes for a swimming pool cleaner having a motor using a vibratory oscillator. In November 1989 at Orlando, Fla., Mr. Sebor disclosed his vibratory oscillator pool cleaner prototypes to Mr. Dieter Rief in confidence and granted to Mr. Rief certain rights to develop the vibratory motor into a working device. Mr. Sebor and Mr. Rief entered into a related written agreement on Sep. 10, 1990.

The swimming pool cleaner contemplated by Mr. Rief using Mr. Sebor's vibratory oscillator design employs flexible bristles extending downwardly from the periphery of the swimming pool cleaner to engage the pool surface to be cleaned. Mr. Rief has licensed Sta-Rite Corporation to manufacture and sell swimming pool cleaners employing the flexible bristle construction. Those products have previously been distributed by Sta-Rite under the trademark "Great White" only for use in cleaning the bottom of above-ground pools, as that cleaner does not have the capability of climbing the side walls of a swimming pool. This flexible bristle construction is the subject of U.S. Pat. No. 5,293,659, in which Mr. Rief, Mr. Sebor and another are named as co-inventors.

SUMMARY OF INVENTION

The present invention is directed to a self-propelled suction cleaner and related methods used with a differential pressure pump and motor for removing dirt and debris from the submerged surfaces of a swimming pool, although the system and method also have utility in other environments. Further, while a suction cleaner is described in detail, the principles described may also be applied to the construction of a pressure outlet cleaner, that is, where fluid flow is out of the bottom of the cleaner.

Conventionally, pool cleaners are connected at a coupling located on top of a housing to a suction pump using a flexible elongated hose. A pool cleaner in accordance with this invention includes a suction chamber located within a housing fabricated of a molded material having a specific density substantially greater than one, which chamber is defined by peripheral walls and an opening proximal to the submerged surface to be cleaned and an exit communicating with the coupling. An oscillator is pivotally mounted within the suction chamber so that a continuous to and fro motion results from the continuous (i.e., uninterrupted) flow of water through the chamber, which in turn imparts a vibratory movement to the cleaner. To facilitate directional movement, the cleaner further comprises elongated tread elements across the bottom of the housing dimensioned to engage the submerged surface to be cleaned while the cleaner is in operation. The elongated tread elements are positioned, shaped and angled with respect to the surface in an arrangement which cooperates with the vibratory to and fro motion of the housing to achieve a directionality of housing movement so that it advances forwardly in a random path over the submerged surface. In accordance with the present invention, the tread elements are segmented and elongated in a direction generally lateral to the direction of travel and define an angular relationship with the bottom of the housing which preferably increases from the front of the housing toward the rear. Additionally, the tread elements are rounded at the peripheral edges to facilitate the movement of the housing along transitions in the pool surfaces, for example the interface between the vertical side walls and the bottom of the pool. While the elongated tread elements are preferably formed of a soft plastic material which avoids damage to a pool surface and will permit the cleaner to pass over protrusions, the material and dimensions of the tread elements are selected so as to prevent significant bending.

The apparatus further includes means for facilitating and maintaining a suction relationship around the bottom opening of the suction chamber and the pool surface to be cleaned; in the preferred embodiment, this means comprises movable flaps positioned forwardly, rearwardly and to either side of the suction chamber opening. In use, the flaps move toward or away from the bottom of the cleaner housing in response to changes in the suction pressure of water flowing across a respective flap, which may occur when the cleaner housing rotates away from the pool surface or when the housing is pulled against the surface. The movement of one or more of the flaps insures that adequate suction is maintained to keep the cleaner housing adjacent the submerged surface across which the pool cleaner is travelling. The cleaner also includes means for immersing the housing and maintaining it immersed in the pool being cleaned.

Preferably, the cleaner is rotatable so as to turn at established intervals throughout the random path and allow the cleaner to free itself from pool obstructions. To achieve this, means are provided for converting the to and fro movement of the oscillator to drive a shaft, with a counter-rotator that permits the discontinuous turning of the housing in either direction at defined intervals.

The cleaner also includes means for limiting the elevation of the cleaner as it climbs a vertical wall of the pool. In one arrangement, a limiter member is affixed to and extends forward and outward from the housing via a flexible coupling, and is dimensioned and disposed such that when the upper end of the member breaks the surface of the water, gravitational force diminishes any forward impetus of the housing. The extended limiter member also acts as a moment arm to turn the cleaner back into the water as the cleaner breaks the surface. The flexible coupling prevents the limiter member from controlling the movement of the housing during operation.

These and other significant features are illustrated in the drawing figures and described in the following specification.

BRIEF DESCRIPTION OF DRAWINGS

A preferred embodiment of the invention as well as alternate embodiments are described by way of example with reference to the accompanying drawings in which.

DETAILED DESCRIPTION OF THE PREFERRED EMBODIMENT

The Major Elements of the Cleaner 10

Figure 7:
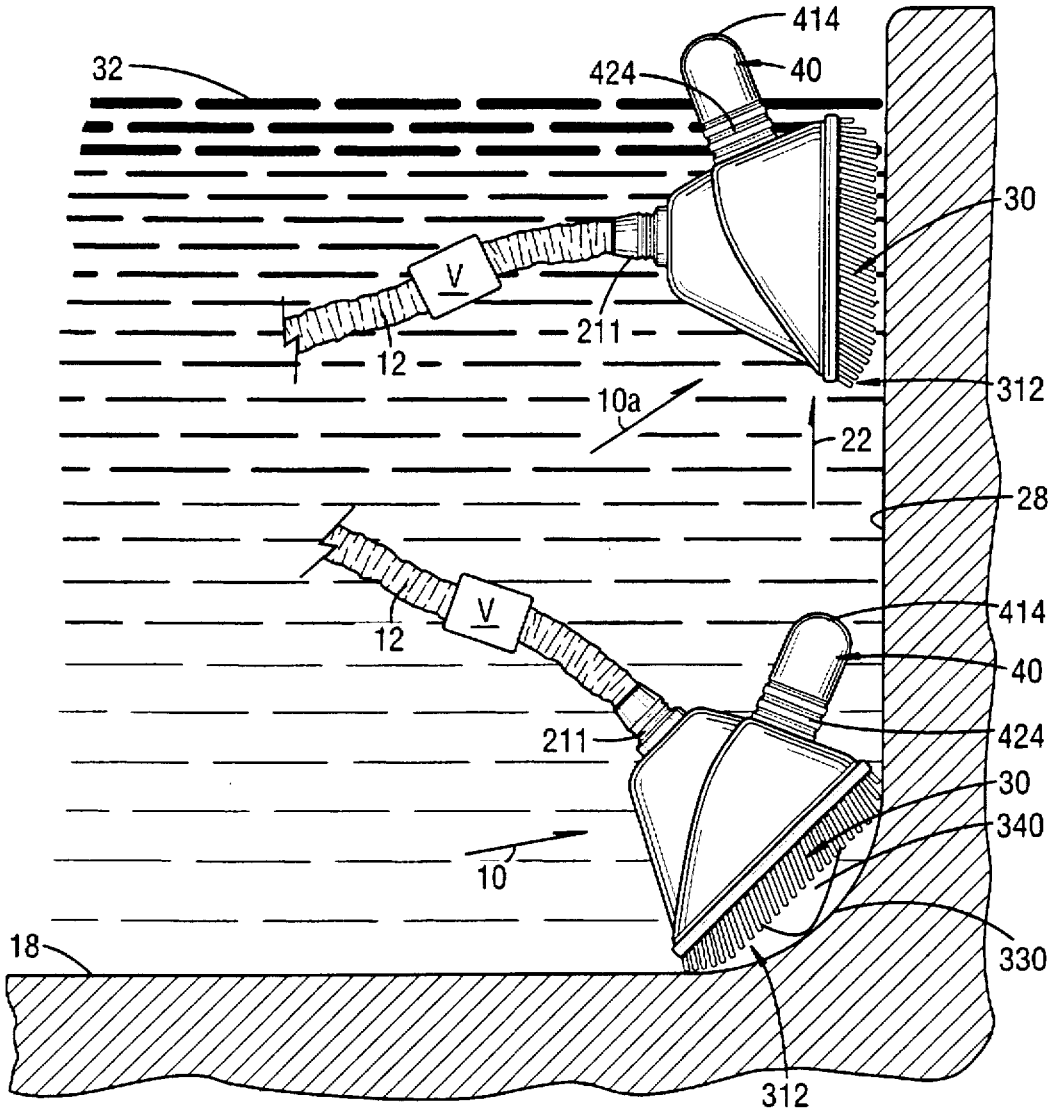
FIG. 7 illustrates the pool cleaner climbing through a surface transition and breaking the surface of the pool.

Referring to FIGS. 1–4, 7, 12 and 13–15, the cleaner 10 of the present invention comprises the following major elements: the housing 20; the shoe 30 removably affixed to the housing 20; the elevation limiter 40 attached to and extending forwardly from a front side of the housing 20; an oscillator 50 providing vibration to the housing 20 and shoe 30; a turning mechanism 60 for converting the to and fro vibratory movement of the oscillator 50 to a unidirectional movement for turning the cleaner 10 (FIGS. 13–15); and an external bypass valve V (FIG. 7).

The Housing 20 and Shoe 30

Figure 1:
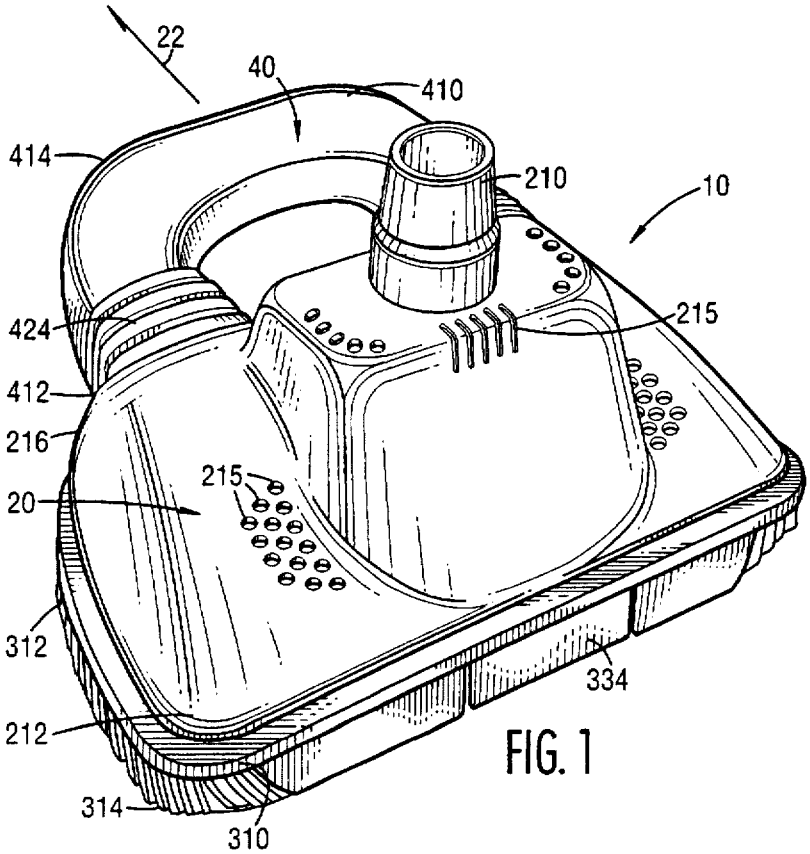
FIG. 1 is a perspective rear quarter view of a self-propelled submersible pool cleaner in accordance with this invention.

The housing 20 is preferably a single molded member forming a housing wall shaped as shown in FIG. 1 with a coupling 210 extending through a top portion thereof, the coupling 210 suitably adapted and dimensioned to be affixed to one end of a flexible hose (not shown). As is well known in the art, the hose is typically connected at another end to a skimmer port through which water is sucked for passage through the pool filtering system.

Figure 2:
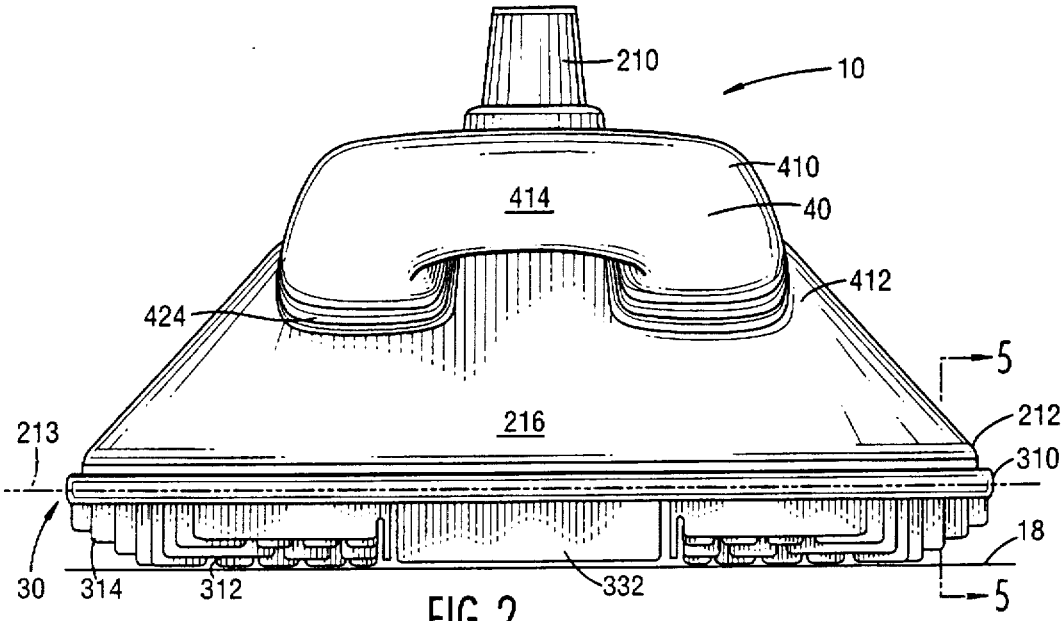
FIG. 2 is a front view of the cleaner of FIG. 1.
Figure 5:
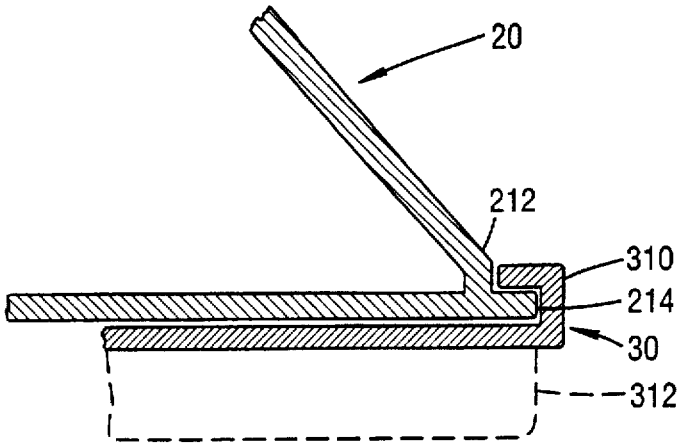
FIG. 5 is a partial cross-sectional view of the housing and shoe of the cleaner of FIGS. 1–4.

As shown in FIG. 2, the housing 20 further comprises a bottom peripheral portion 212 dimensioned within a plane 213 generally parallel to a pool surface 18. With reference to FIGS. 1, 2 and 5 a shoe 30 is removably attached to the housing peripheral portion 212 and comprises a rim 310 dimensioned to be received by a flange 214 extending around the housing peripheral portion 212. The shoe 30 is formed as a unitary molded member and is made from a material sufficiently elastic to stretch the shoe rim 310 for biasing onto the housing peripheral flange 214 of the housing peripheral portion 212 (FIG. 5).

Figure 4:
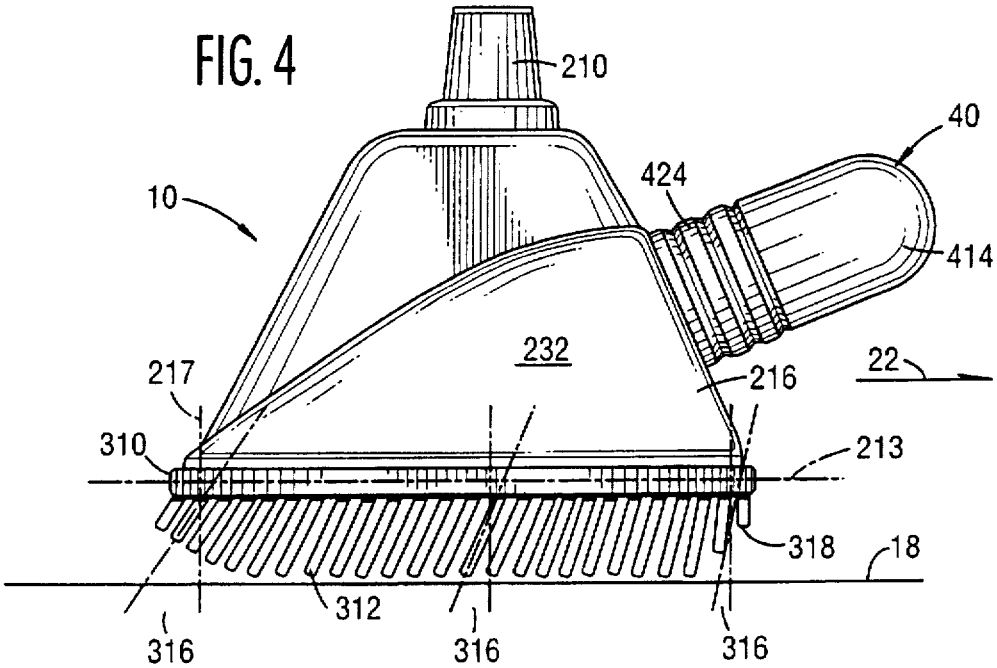
FIG. 4 is a side view of the cleaner of FIGS. 1, 2 and 3.

As illustrated in FIG. 4, the shoe 30 has tread elements 312 with ends 314 for contacting the submerged pool surface 18. The tread elements 312 are angled backwards with respect to the direction of travel 22. In particular, tread elements 312 near the forward portion 216 of the housing have angles 316 ranging from 2° to 8° rearward from a perpendicular to the housing peripheral plane 213. Those elements 312 proximate a housing mid portion 232 ranging from 8° to 9° and those elements 312 at a housing rear portion 217 ranging from 9° to 12°. In the preferred embodiment of the invention, the front most tread element 318 is generally perpendicular to the plane 213. These angled 316 tread elements 318 and the interaction of the continuous vibratory (i.e., rocking/bouncing) motion of the housing 10 provides a preferred direction of travel 27 to the cleaner 10 and thus propels the cleaner 10 over the submerged surface 18 of the pool for dislodging debris and sucking the debris through the chamber 218 and into the filtering system 16 as earlier described.

In the preferred embodiment, tread elements 318 are manufactured using a resilient rubber-like material which will allow the tread elements 318 to yield somewhat as the cleaner 10 traverses protrusions in the pool or twigs and debris on the surface to be cleaned, but which do not bend significantly when supporting the weight of the cleaner 10 and to impart movement.

With reference to FIGS. 1–5 and 7, the tread elements 312 are in the form of a multiplicity of elongated track elements 322 spaced and generally parallel to each other and extending laterally across the width 326 of the shoe 30. Each element 322 extends generally normal to the direction of travel 22 of the cleaner 10.

Figure 9A:
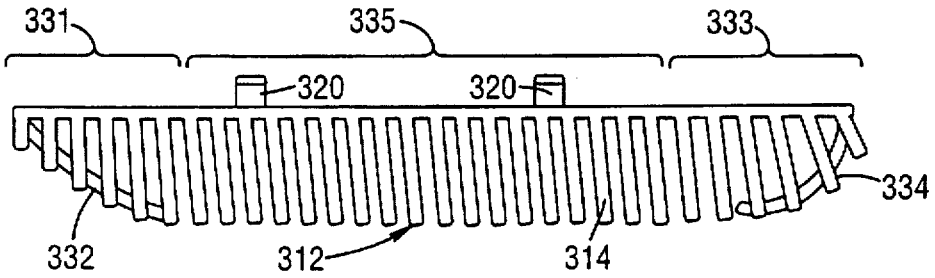
FIG. 9*a* is a partial side view of one form of an integral shoe of the present invention.
Figure 9B:
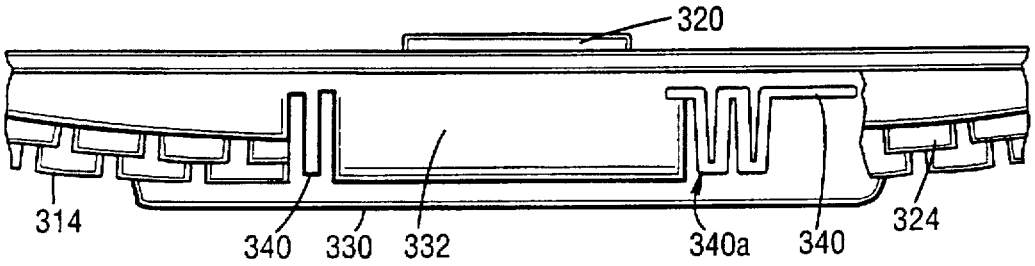
FIG. 9*b* is a partial front view of the shoe of FIG. 9*a;*
Figure 10:
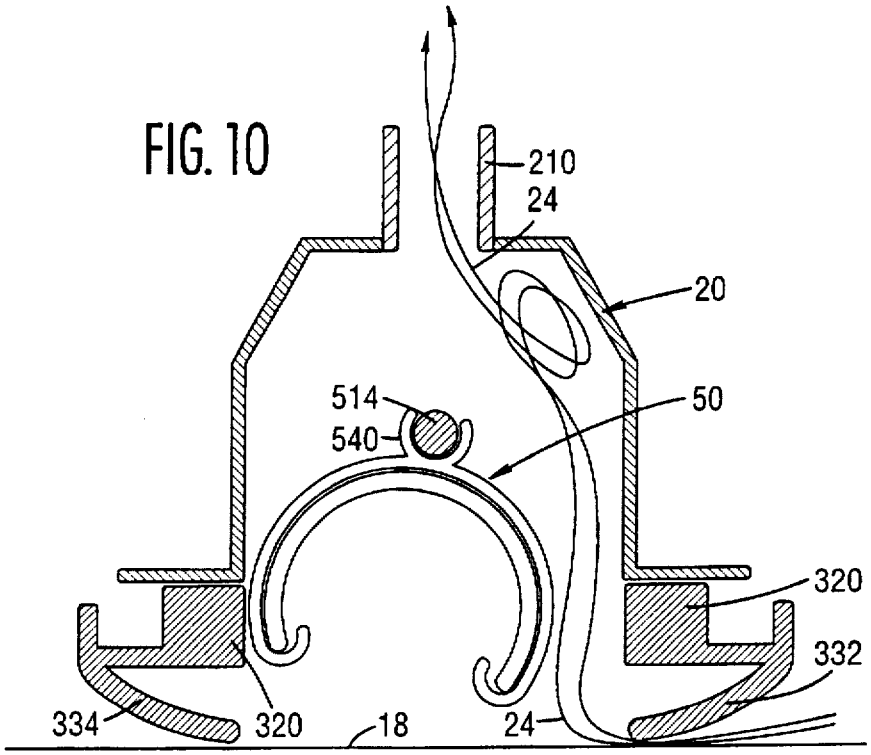
FIG. 10 is a partial cross-sectional side view of the suction chamber and shoe illustrating the integration of the buffer formations and flaps into the shoe.

As shown in FIG. 4, a portion of the tread element ends 314 are in contact with a generally flat surface 18. Those elements 312 making contact with the surface 18 are generally located proximate the chamber mouth 220 and along the housing mid-portion 232. Noting FIG. 9*a*, there is shown a specific form of the shoe 30 comprising thirty parallel rows of tread elements 312 having the forward six rows 331, and rear six rows 333 spaced from the generally flat surface 18 with respect to the middle eighteen rows 335, the middle rows 335 thereby generally contacting the surface 18 during normal operation of the cleaner 10 while travelling over a generally flat surface. (Note the depiction of the cleaner 10 during operation at FIG. 7). The forward rows 331 and rear rows 333 make contact with the submerged surface 18 at typical wall transitions 34 as illustrated in FIG. 7. In addition to the generally curved cross section for the end portion elements 314 laterally across the shoe width, there is a generally flat portion for the elements 312 within the shoe center portion 330 as illustrated in FIG. 9*b*. As a result of the generally rounded shoe profile, turning the cleaner about an axis through the coupling 210 is facilitated as well as improved for maneuvering of the cleaner 10 over uneven surfaces or through dramatic surface changes.

Figure 3:
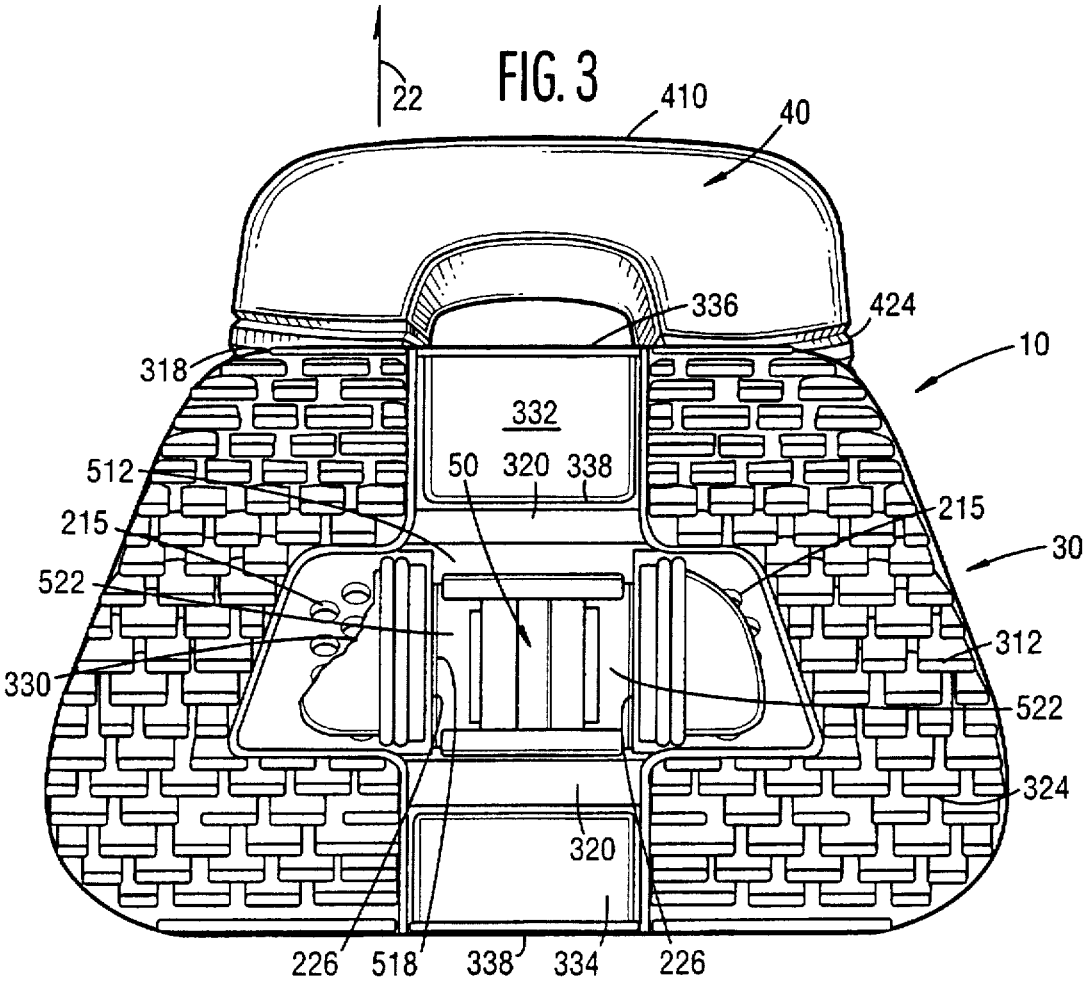
FIG. 3 is a bottom view of the cleaner of FIGS. 1 and 2 illustrating the segmented tread elements, the front, rear and side flaps and the tabs.

As shown in FIGS. 1 and 3, the housing 20 and shoe 30 include plural holes 215 which immerse the housing 20 and maintain the housing in an immersed condition. Additionally, the bottom holes 215 in the shoe 30 avoid the formation of vortices if the cleaner 10 is moving adjacent the surface or the pool.

In an alternate embodiment, as illustrated with reference to FIG. 8*b*, a shoe **30*a* having a generally rounded profile incorporates rows of tread elements 312 which in the area of the four corners 301 of the cleaner are aligned such that the opposing corner elements generally are parallel to each other. This configuration facilitates the forward movement of the cleaner when such corner elements 301** engage a concave surface to be cleaned.

The present invention employs a housing 20 and shoe 30 combination having a forward edge which is generally straight and lateral to the direction of the movement. When the machine travels through a curve as illustrated in FIG. 7, the forward rows 331 and rear rows 333 will make contact with the submerged surface 18. Regardless of the shape of the leading edge of the cleaner when viewed from above, sufficient element ends 34 must end in a profile which will allow as many element ends 34 to engage the surface to be cleaned. The generally curved element ends 301 at the forward rows 331 and rear rows 333 enhance the ability of the housing 20 to vibrate and rock back and forth in sympathy with the movement of the oscillator 50, thereby enhancing the ability of the cleaner to move in a preferred direction of travel 27.

Figure 8A:
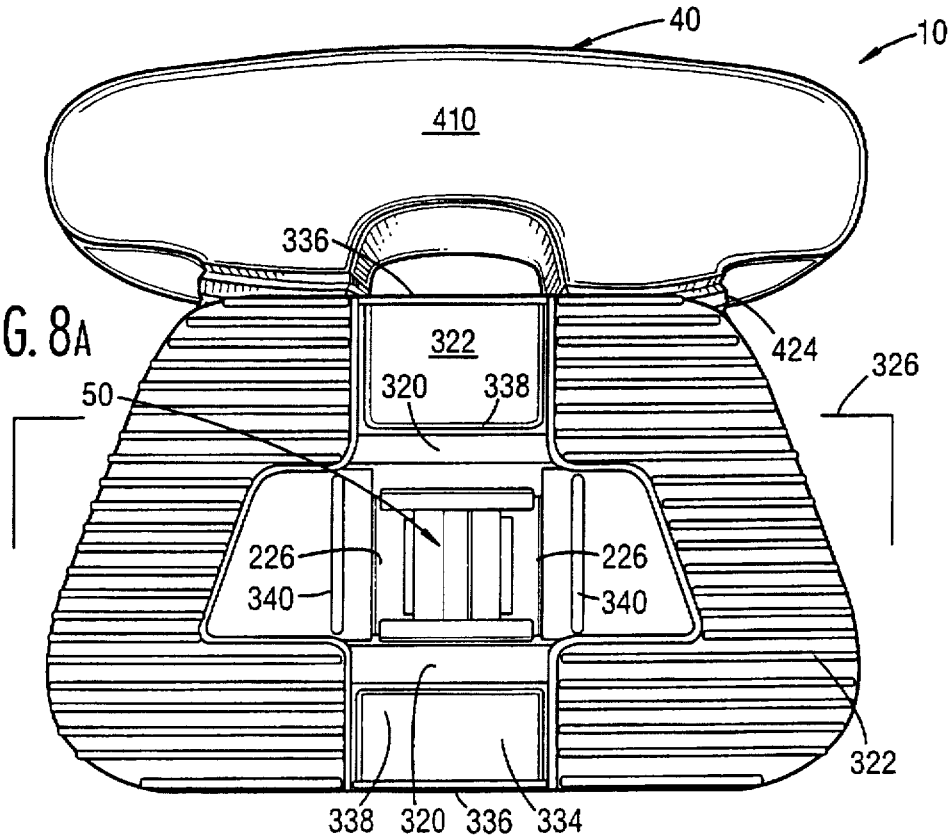
FIGS. 8*a* and 8*b* illustrate alternate tread configurations for the cleaner.
Figure 8B:
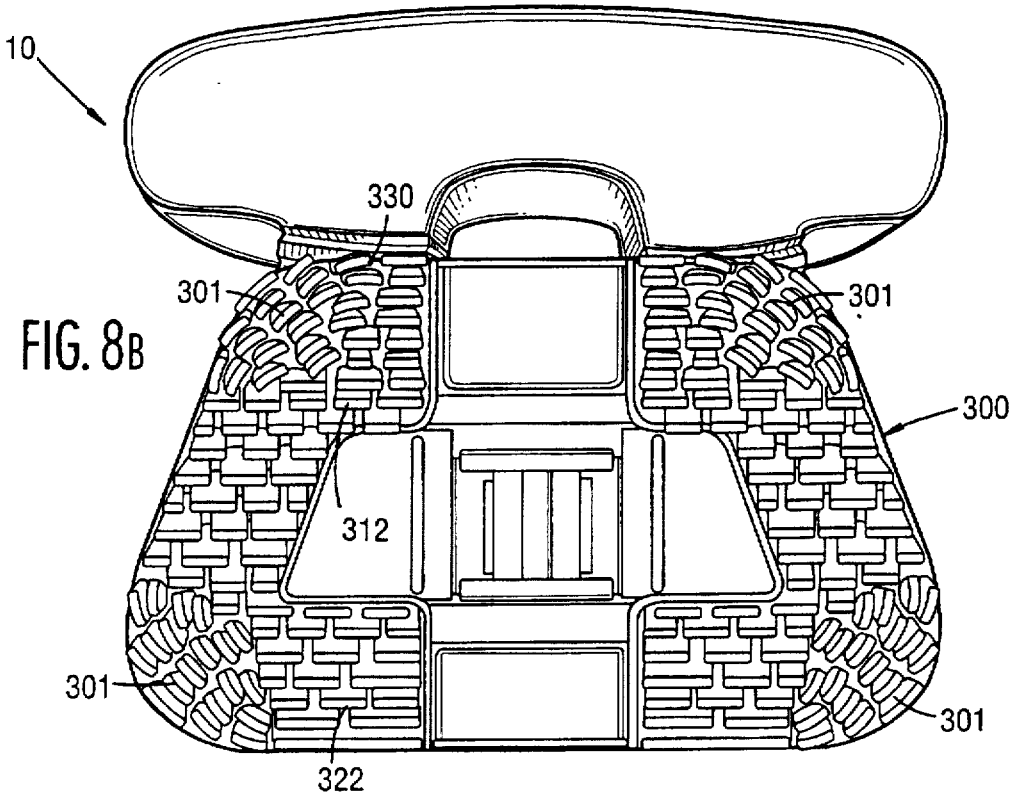

Noting FIGS. 3, 8*a* and 8*b*, the shoe 30 further comprises a front flap 332 and an opposing rear flap 334 each having a flap peripheral portion 336 hingeably affixed to the shoe rim 310 to permit the flap inner portion 338 to flex as water flows between the flaps 332 and 334 and the submerged surface 18 over which the cleaner 10 is operating. In addition, internal flexible side flaps 340 are affixed at the shoe center portion 330 via a living hinge 340*a* proximate the chamber mouth 220 such that the flaps 332, 334 and 340 in combination surround the mouth 220 for maintaining suction against the submerged surface 18. As illustrated in FIGS. 9*a* and 9*b*, the flaps 332, 334 and 340 are dimensioned to lie within a contour of the element ends 314 to allow a small gap between the flaps 332, 334 and 340 and the submerged surface 18, thus avoiding contact with the submerged surface 18. In the preferred embodiment of the present invention, the flaps 332, 334 and 340 are integrally formed as part of the shoe 30 as are the tread elements 312.

To enhance this climbing feature, a flexible coupling bellows 211 as illustrated in FIG. 7 may be fitted to the coupling 210. This bellows 211 provides added flexibility to the end of the flexible hose 12 and improves the ability of the cleaner 10 to climb the steep vertical pool walls.

The Oscillator 50 and Associated Chamber

Figure 6A:
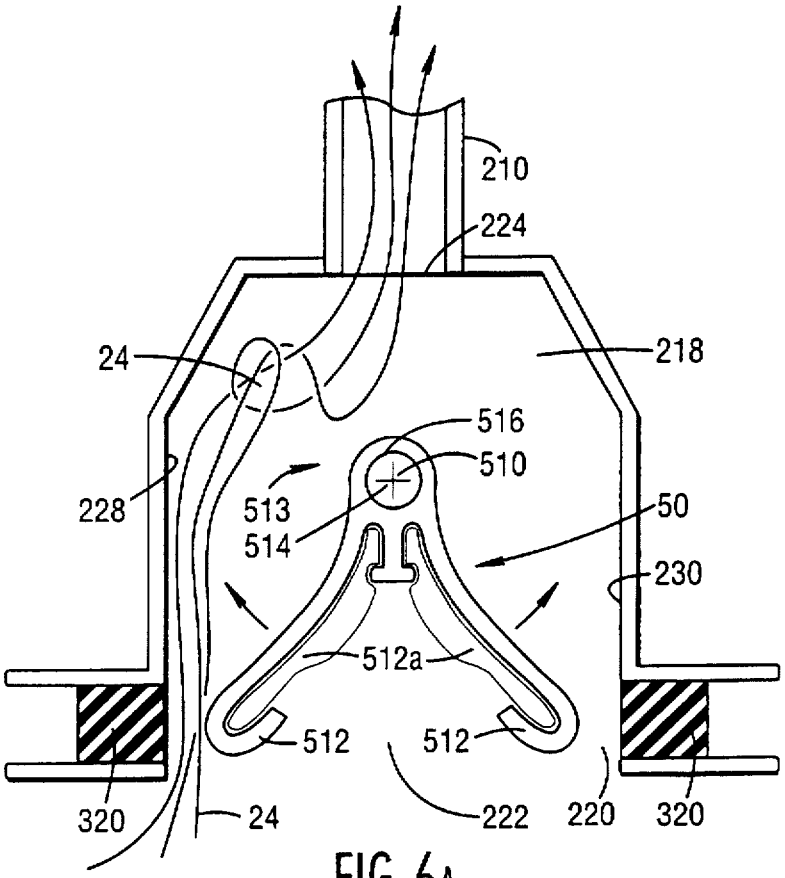
FIG. 6*a* is a partial cross-sectional side view of the suction chamber of the cleaner of FIGS. 1–4.

As shown in FIGS. 1, 3 and 6*a*, the housing 20 defines a suction chamber 218 defined by walls 226, 228 and 230 and having a mouth 220 located at an entrance end 222 in which water flows under the action of the pool system pump. A chamber exit end 224 communicates with the coupling 210 such that the coupling 210 is in fluid communication with the chamber 218.

The propulsion mechanism for the cleaner 10 comprises an oscillator 50 pivotally mounted to the side walls 226 of the chamber 218 as illustrated in FIG. 3, with sliding seals 512*a* loosely fitting inside the oscillator. The oscillator 50 and seals may be either symmetrical as shown in FIG. 6*a* and in Mr. Sebor's earlier U.S. Pat. No. 5,371,910, or asymmetrical as shown in co-pending application Ser. No. 08/307,938 filed Sep. 16, 1994, both of which are incorporated here by reference. As will be understood from FIGS. 3 and 6*a*, the oscillator 50 is disposed within the flow path 24 of water through the suction chamber 218 caused by connecting the coupling 210 through a hose to a filter pump. The oscillator 50 is so shaped that flow past the oscillator (as illustrated by flow lines 24 in FIG. 6*a*) causes it to move to and fro about its pivot point 510 and impact the forward wall 228 and aft wall 230 of the chamber 218 to create a vibratory movement of the cleaner 10.

As noted previously, the suction chamber 218 located within the housing 20 is comprised of the side walls 226, forward wall 228 and aft wall 230, the forward 228 and aft 230 walls defined by the housing 20 as described with reference to FIGS. 3 and 6*a*, the oscillator 50 is pivotally mounted within the suction chamber 218 on a hinge pin 514 extending through a hole 516 in the oscillator 50, the hinge pin 514 being journaled on the side walls 226.

Again referring to FIG. 6*a*, the liquid flow 24 into the suction chamber 218 via the mouth 220 of the housing 20 impinges on the oscillator 50 flowing around the extremities 512 causing the oscillator 50 to swing to and fro on the hinge pin 514 between the chamber forward 228 and aft 230 walls as illustrated in FIGS. 6*a* and 3. Buffer formations 320 are positioned between the oscillator extremities 512 and chamber walls 228 and 230.

Figure 6B:
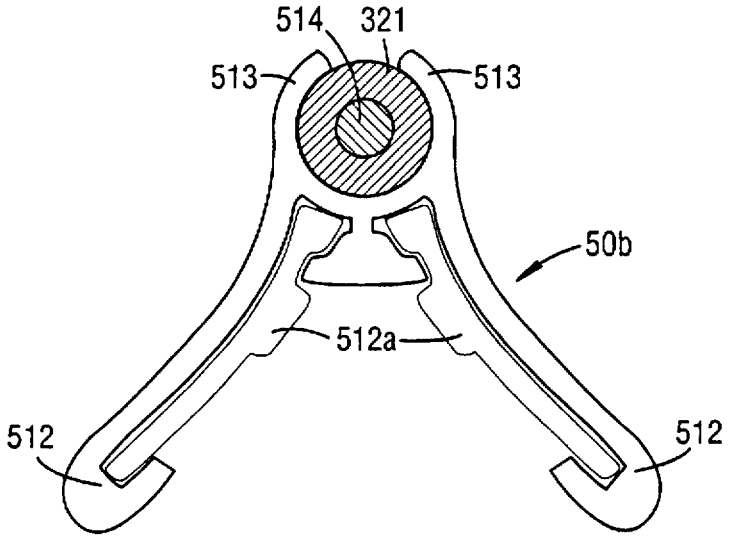
FIG. 6*b* is a side view of a first alternate oscillator/buffer embodiment useful with the suction configuration of FIG. 6*a;*

Alternate oscillator embodiments are illustrated with reference to FIGS. 6*b* and 6*c*. In FIG. 6*b*, a buffer formation 321 is positioned on the pin 514 in contact with the oscillator 50*a*, which is formed to snap on and attach to buffer formation. In yet another embodiment shown in FIG. 6*b*, the extremities of the oscillator 50*b* are formed of suitable impact absorbing material 321*a*

The efficiency of the to and fro movement of the oscillator 50 depends on the strength of flow 24 between the oscillator extremities 512 and 513. With reference to FIGS. 3 and 6*a*, the ability of liquid to flow around the side edges 518 of the oscillator 50 between the side edges 518 and the chamber side walls 226 will diminish the strength of the flow 24 past the oscillator extremities 512 and cause a consequent drop in the efficiency of the propelling action of the oscillator 50. In order to prevent such dissipation of energy, the oscillator 50 is dimensioned in one embodiment for close tolerance and a minimum gap 520 between the chamber side walls 226 and oscillator edges 518 so that little flow 24 is dissipated. In this event, however, grit or debris drawn into the suction chamber 218 can lodge between the oscillator side edges 518 and chamber side walls 226 thereby causing reduced to and fro movement and therefore loss of efficiency of the oscillator 50 through friction, and the oscillator 50 may even stick.

The oscillator 50 is dimensioned such that the side edges 518 are suitably spaced from the chamber side walls 226 as illustrated in FIG. 3 to enable grit to pass easily therethrough. Retractable elongated seals 522 are provided at each side edges 518 of the oscillator 50 to close the gap 520 between the oscillator side edges 518 and the chamber side walls 226 as illustrated in FIG. 3, and as is described in Mr. Sebor's U.S. Pat. No. 5,371,910, as discussed above. This minimizes the liquid and any accompanying grit and debris flow 24 between the side edges 518 and the chamber side walls 226. Preferably, the elongated seals 522 are loosely fitted in slots 524 in the respective side edges 518.

Figure 6C:
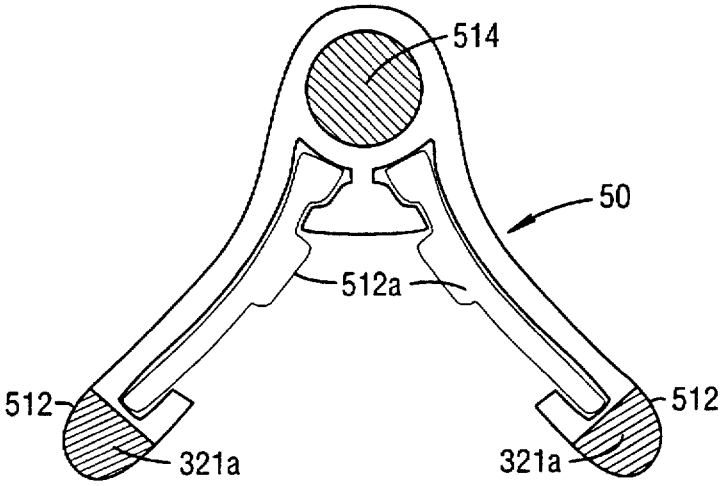
FIG. 6*c* is a side view of a second alternate oscillator/buffer embodiment.

With reference to FIGS. 6*a*–6*c*, the oscillator 50 has a generally "bell-shaped" cross-section, that is, each blade of the oscillator 50 is concave with respect to the interior of the suction chamber.

Figure 11:
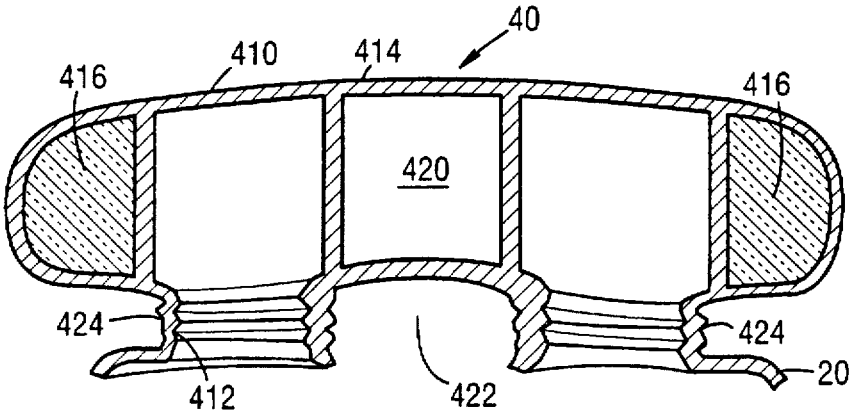
FIG. 11 is a partial cross-sectional view of an elevation limiter in an alternate weighted embodiment.
Figure 12:
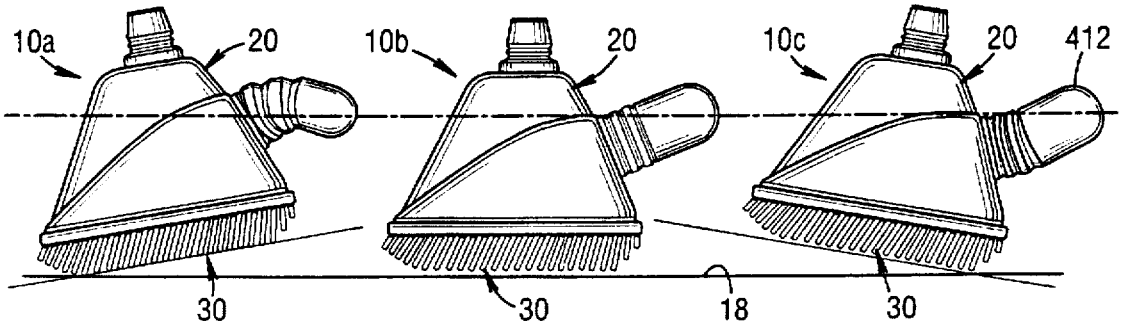
FIG. 12 illustrates the hinging movement of the housing and elevation limiter about the bellows during the vibratory movement of the cleaner.

Because of the strength and frequency of the impact on the forward 228 and aft 230 chamber walls by the oscillator 50, buffer formations 320(FIG. 3) are affixed to the chamber walls 228 and 230 at a location for receiving the oscillator ends 512. In the preferred embodiment these buffer formations 320 are rubber-like pads. These buffer formations 320 thus protect the housing 20 and in general the cleaner 10 from damage resulting from the action of the oscillator 50. In the preferred embodiment, the buffer formations 320 are integrally formed within the shoe 30 as illustrated in FIGS. 3 and 11*a*.

The Elevator Limiter 40

With reference to FIGS. 1–4, the cleaner 10 includes an elevation limiter 40 extending from a forward portion 216 of the housing 20 as defined by a generally forward direction of travel 22 for the cleaner 10 during normal operation.

The cleaner 10 climbs submerged vertical walls 28 as shown in FIG. 7, typical of swimming pools and then reaches the surface 32 of the water. As illustrated by way of example as cleaner 10A in FIG. 7, the elevation limiter 40 in fluid communication with the housing 20 stops the forward progress of the cleaner 10 as the limiter 40 breaks the water surface 28 due to the increased gravitational force on apparent weight increase of the limiter 40 out of the water. As a result, the suction chamber 218 continues to receive a flow of water and avoids the detrimental sucking of air by the pump.

In one embodiment of the present invention, the elevation limiter 40 comprises an inverted "C"-shaped tube 414 connected at its base ends 412 to the housing 20 for placing the member 410 in fluid communicate with the housing 20.

As illustrated in FIG. 1 and FIG. 4, the member 410 extends upwardly and forwardly with respect to the housing 20 and when the latter is immersed in a pool the member 410 fills with water. To enhance the water filling process, apertures 415 are provided within a wall of the member 410 proximate the housing 20. With forward motion 42 of the cleaner 10 up a vertical wall 28 as illustrated in FIG. 7, the cleaner 10 rises until the upper end of the member 410 breaks the surface of the water while the suction chamber 218 of the housing 20 remains submerged within the water. As the member 410 emerges from the water, it undergoes an apparent weight gain. The member 410 is dimensioned such that the weight gain prevents further forward impetus of the cleaner 10 keeping the suction chamber 218 just beneath the surface 32. In this way the member 410 operates as an elevation-limiting device preventing the suction chamber 218 from breaking the water surface 32 and drawing in air which would impair the operation of the pump.

Figure 13:
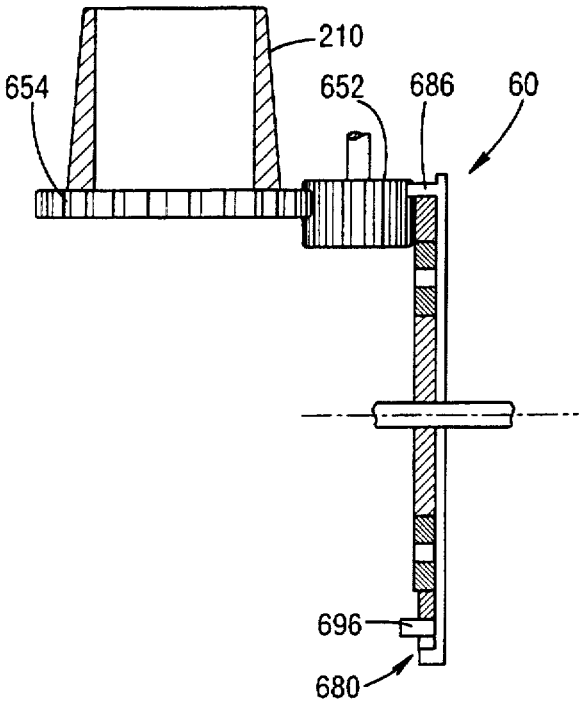
FIG. 13 is a partial cross-sectional side view of a counter rotating gear useful as a turning mechanism for the cleaner of the present invention.

In an alternate embodiment, the forward most portion 414 is filled with a weighting material 416. By way of example, the end portions 418 of the pi-shaped member 410 are weighted to distribute the apparent weight of the member 410 toward the sides of the cleaner 10. Such an arrangement enhances the turning of the cleaner 10 back toward the submerged surfaces when the cleaner 10 exits the water in other than true vertical direction. To further distribute the weight of the member 410 toward the ends 418, an air chamber 420 is placed within a central portion 422 of the member 410 as illustrated in FIG. 13.

By adding a flexible portion in the form of limiter bellows 424 to the extension member 410 at the member base 412 proximate the housing 20 as illustrated in FIGS. 1, 4 and 7, the vibratory motion of the housing 20 results in a hinging of the limiter member 410. The hinging reduces the resistance created by the movement of the member 410 through the water thereby allowing an unrestrained vibration to the housing 20 and thus efficient operation of the cleaner 10. The flexible nature of the bellows 424 provides a sufficiently reduced moment arm and provides the smoother forward movement for the cleaner 10. As illustrated by way of example with reference to FIG. 12, the limiter member 412 follows a uniform path 426 generally parallel to the surfaces 18 to be cleaned while the cleaner housing 20 hinges about the bellows 424 during its vibratory and thus somewhat bouncing movement over the surface as illustrated in the sequence for cleaner 10*a*, 10*b* and 10*c*.

The Turning Mechanism 60

The cleaner 10 is propelled in the forward direction 22 as described and typically takes a somewhat random path determined by the pool surface contours peculiar to any given swimming pool. To improve the ability of the cleaner 10 to venture into all areas of a pool surface and to avoid developing a repeated path pattern, the preferred embodiment of the present invention incorporates a turning mechanism 60 useful with the rotatable coupling 210 and a mechanism for converting the continuous vibratory (i.e., oscillating/rocking) motion of the oscillator 50 to a rotating unidirectional motion for turning the cleaner 10 left and right at various intervals. Such turning during the typically random path of the cleaner 10 will insure that the path does not establish an unwanted repeating pattern. In addition, should the cleaner 10 encounter an obstacle such as the steps, typically found in swimming pools or be stopped at the water surface 32 as described earlier or inadvertently land in a position where the shoe does not engage the surface to be cleaned, a 90° or greater turn will permit the cleaner to maneuver away.

In the preferred embodiment, the turning mechanism is discontinuously engaged with the rotatable coupling. This allows the hose to spring back to a relaxed position, thus releasing any excessive twist in the hose and thereby avoiding unwanted loop formations in the hose.

In Mr. Sebor's prior U.S. Pat. No. 5,404,607, there is described a positive engagement clutch and a turning mechanism for discontinuously turning the cleaner in one direction. There is disclosed below an improved mechanism for discontinuously turning in two directions.

Figure 14:
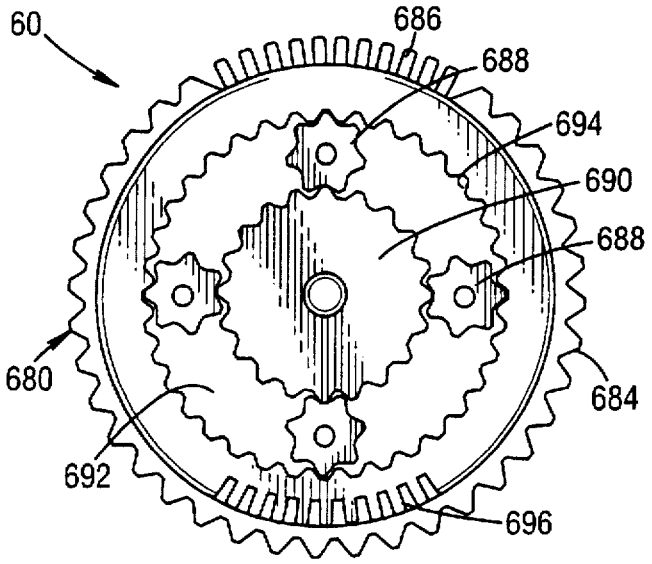
FIG. 14 is an open face view of gears in the counter rotating gear of FIG. 14.
Figure 15:
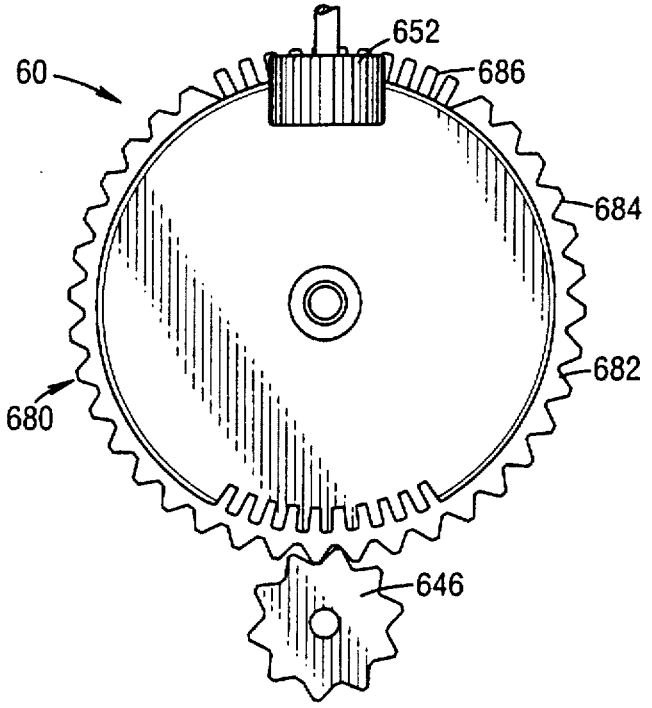
FIG. 15 is a partial front face view of the counter rotating gear arrangement of FIGS. 14 and 15, shown communicating with the coupling and gear train gears.

As described with reference to FIGS. 13–15, the turning mechanism 60 for turning discontinuously in either direction comprises a counter rotating gear mechanism 680 which in essence replaces the internal drive gear described in the above-referenced patent, Sebor '607. As described in Sebor '607, beginning Col. 11, line 58, the entire disclosure of which is incorporated herein by way of reference, a drive mechanism using a pawl and ratchet arrangement translates reciprocating angular movement of a driven gear by the oscillator for driving a gear train mechanism. The gear mechanism 680, herein described, is a part of the gear train mechanism. The gear mechanism 680 comprises an outside drum gear 682 having peripheral teeth 684 for engaging and being driven by the gear train and as described in sebar '607. The outside drum gear 682 further comprises internal gear teeth 686 extending outward from the periphery parallel to the axis of rotation for engaging the intermediate gear 652 and within the coupling gear 654 as did the interval drive gear of sebar '607. A multiplicity of translation gears 688 engage an interval gear 690 coaxially affixed to the outside drum gear 682. An inside drum gear 692 comprises inwardly directed teeth 694 for engaging the translational gears 688. The inside drum gear 692 rotates coaxially with the outside drum gear 682 in an opposing direction of rotation. The inside drum gear 692 further comprises interval gear teeth 696 dimensioned for engaging the intermediate gear 652 which in turn engages the coupling gear 654 for rotating the coupling 210.

In the present invention, the outside drum interval teeth 686 and the inside drum gear interval teeth 696 are positioned to turn the coupling 210 at alternating intervals with an intermediate interval where no engagement of the interval teeth takes place to allow any twisting or torsion of the hose 12 to freely neutralize. With such an arrangement, the counter rotating gear mechanism 680 covers the cleaner 10 to be turned to the left during one interval and to the right during another and thus provide turning for the cleaner 10 to maneuver through the various obstacles encountered in a typical swimming pool.

The External Bypass Valve V

As shown in FIG. 7, the cleaner 10 also includes an external bypass valve V positioned in close proximity to the coupling 211 to assist in regulating water pressure through the cleaner 10. While the use of such valves at the pool skimmer is well known, it has been determined through experimentation that positioning the valve V in close proximity (not more than about two feet sway) to the cleaner 10 provides greatly improved pressure regulation.

While specific embodiments of the invention have been described in detail herein above, it is to be understood that various modifications may be made from the specific details described herein without departing from the spirit and scope of the invention as set forth in the appended claims.

Having now described the invention, the construction, the operation and use of preferred embodiments thereof, and the advantageous new and useful results obtained thereby, the new and useful constructions, methods of use and reasonable mechanical equivalents thereof obvious to those skilled in the art, are set forth in the appended claims.

What is claimed is:

1. Apparatus for traveling along a direction across a surface comprising:

a housing having a bottom, a relatively straight forward edge elongated in a direction generally lateral to the direction of travel and generally parallel to the bottom, and a rear;

means coupled with the housing for imparting a continuous vibratory movement to the housing;

rows of treads extending from the bottom of the housing, at least some of the treads being segmented into individual tread elements, each tread element elongated in a direction which is generally parallel with both the direction of elongation of the front edge and the bottom, substantially all, of the tread elements each having a portion which is angled rearwardly with respect to the direction of travel; and wherein the tread elements are collectively shaped and rounded at the peripheral edges of the housing to facilitate the movement of the apparatus through transitions.

2. The apparatus recited in claim 1 wherein portions of the segmented tread elements adjacent the forward edge extend a shorter distance from the bottom than other tread elements so as to be out of contact with a surface across which the apparatus is travelling unless the apparatus is moving through a transition.

3. The apparatus recited in claim 1 further comprising a shoe member, and wherein the tread elements extend from the shoe member, and means for removably attaching the shoe member to the housing adjacent the bottom thereof.

4. The apparatus recited in claim 3 wherein the shoe member is integrally molded with the tread elements.

5. The apparatus recited in claim 1 wherein the housing comprises an internal fluid suction chamber defined by interior walls, the suction chamber enclosing a volume which is only a portion of the interior of the housing and having a bottom opening through the housing bottom and a top opening through a top portion of the housing.

6. The apparatus recited in claim 5 wherein the tread elements surround a substantial portion of the bottom opening of the suction chamber.

7. The apparatus recited in claim 6 further comprising suction-sustaining flaps positioned around the bottom opening of the suction chamber.

8. Apparatus for traveling along a direction across a surface comprising:

a housing having a bottom, a forward edge elongated in a direction generally lateral to the direction of travel and generally parallel to the bottom, and a rear;

means coupled with the housing for imparting a continuous vibratory movement to the housing;

rows of treads extending from the bottom of the housing, at least some of the treads being segmented into individual tread elements, each tread element elongated in a direction which is generally parallel with both the direction of elongation of the front edge and the bottom, substantially all of the tread elements each having a portion which is angled rearwardly with respect to the direction of travel and wherein means for maintaining fluid flow through the housing in response to changes in fluid flow pressure, the fluid flow maintaining means comprising resilient flap means extending from the housing; and wherein the vibratory movement imparting means comprises means responsive to flow of fluid through the housing.

9. The apparatus recited in claim 8 wherein the fluid is water, the apparatus further comprising means for submerging the housing in a pool of water having a submerged bottom and generally vertical submerged side walls.

10. The apparatus recited in claim 9 further comprising means for preventing the apparatus from exiting a pool in which the apparatus is submerged.

11. The apparatus recited in claim 10 wherein the exit preventing means comprises an elevation limiter extending forwardly from the housing in the direction of travel and beyond the forward edge.

12. The apparatus recited in claim 11 further comprising means for flexibly hinging the elevation limiter to the housing.

13. The apparatus recited in claim 9 wherein the vibratory movement imparting means comprises an oscillator pivotally mounted on a pivot axis in the housing, the oscillator moving continuously to and fro about the pivot axis within the housing responsive to the flow of water therethrough.

14. The apparatus recited in claim 13 wherein the oscillator comprises a forward arm and a rearward arm with the pivot axis between the two arms.

15. The apparatus recited in claim 14 wherein the arms of the oscillator are dimensioned to engage respective front and rear walls within the housing.

16. The apparatus recited in claim 15 further comprising means for buffering impacts between the front and rear walls and the respective forward and rear arms of the oscillator.

17. The apparatus recited in claim 13 further comprising means permitting the oscillator to be removably attached in the housing from the bottom.

18. The apparatus recited in claim 17 wherein the removable attaching means comprises a portion of the oscillator defining a partially open clip for snapping on to and being removed from the pivot axis without disassembly.

19. A submersible cleaner for travelling across surfaces of swimming pools in a direction of travel and which avoids significant wear on an associated suction pump, the cleaner comprising:

a housing forming an enclosure having a top portion, a generally planar bottom, a generally straight forward edge elongated in a direction both generally lateral to the direction of travel and generally parallel to the plane of the bottom; and a rear;

a suction chamber within the housing enclosure and defined by internal front, rear and side walls, the suction chamber having a top opening extending into the top portion of the housing and a bottom opening generally communicating with the bottom of the housing;

a vibratory oscillator pivotally mounted within the suction chamber for vibrating the cleaner; and a shoe member removably fitted to the bottom of the housing and having rows of molded tread elements extending from the shoe member downwardly from the bottom and adapted to engage a surface across which the cleaner is travelling, substantially all of the tread elements being elongated (extending) generally parallel both with the direction of elongation of the forward edge and the plane of the bottom, substantially all of the tread elements having a portion which is angled rearwardly with respect to the direction of travel.

20. The apparatus recited in claim 19 further comprising means for immersing the pool cleaner in a swimming pool and maintaining the cleaner immersed during operation.

21. The apparatus recited in claim 20 wherein the immersion means comprises a plurality of holes extending through the housing top portion and through the shoe member adjacent the bottom of the housing.

22. The apparatus recited in claim 20 wherein the immersion means comprises an elevation limiter extending from the top portion of the housing and beyond the forward edge toward the direction of travel.

23. The cleaner recited in claim 19, further comprising buffer means between the housing and the oscillator.

24. The cleaner recited in claim 19 wherein the rearward angle of the tread element portions increases from the forward edge to the rear of the housing.

25. The cleaner recited in claim 19, further comprising flaps disposed about the suction chamber bottom opening, the flaps maintaining suction during operation of the cleaner.

26. The cleaner recited in claim 19 wherein portions of the tread elements adjacent the forward edge extend a shorter distance from the bottom than other tread elements so as to be out of contact with a surface across which the apparatus is travelling unless the cleaner is moving through a transition.

27. The cleaner recited in claim 26 wherein the tread elements are collectively rounded at the forward, rear and peripheral side edges.

28. The cleaner recited in claim 19 further comprising pressure regulation means external to, and in close proximity with the top opening of the suction chamber.

29. The submersible cleaner recited in claim 19 wherein substantially all of the tread elements are each angled rearwardly at a uniform angle along the length thereof.

* * * * *